United States Patent [19]

Wuntch

[11] 4,057,958

[45] Nov. 15, 1977

[54] WATCH WINDER

[76] Inventor: Thomas Wuntch, 10638 Boedeker St., Dallas, Tex. 75230

[21] Appl. No.: 724,867

[22] Filed: Sept. 20, 1976

[51] Int. Cl.[2] ..... G04B 3/00; G04D 3/00

[52] U.S. Cl. ..... 58/82 R; 58/80; 81/7.5

[58] Field of Search ..... 58/63, 80, 82; 81/7.5

[56] References Cited

U.S. PATENT DOCUMENTS

| | | | |
|---|---|---|---|
| 2,863,345 | 12/1958 | Fiechter | 81/7.5 |
| 2,917,955 | 12/1959 | Leger | 81/7.5 |
| 3,620,007 | 11/1971 | Kauffman | 58/80 |

*Primary Examiner*—E. S. Jackmon
*Attorney, Agent, or Firm*—Crisman & Moore

[57] ABSTRACT

Apparatus is provided for the winding of a self-winding mechanical wrist watch during intervals when it is not worn on the wrist and would otherwise run down and stop. The apparatus comprises a detachable, padded mandrel over which the self-winding wrist watch is placed and securely held by its own strap or band. The mandrel holding the watch is attached to a revolving winding shaft driven at slow speed by a motor wherein the relationship of the watch to the winding shaft is such that the axis of rotation of the stem of the internal self-winding rotor of the watch is generally coincident with the axis of rotation of the winding shaft.

14 Claims, 3 Drawing Figures

WATCH WINDER

BACKGROUND OF THE INVENTION

1. Field of the Invention

The invention relates to an automatic watch winding apparatus, and, more particularly, to a watch winder for selfwinding mechanical wrist watches.

Wrist watches which do not require manual winding are commonly available in two varities, to wit: electric or battery operated, and mechanically self-winding. Battery powered watches operate for the life of the battery. Selfwinding watches operate as long as there is sufficient physical movement, of the proper form, to actuate internal winding mechanisms contained therein. Oftentimes a watch wearer may not wear the watch, for one reason or the other, and the winding mechanism is not actuated, resulting in the running down and stopping of the watch. During such periods of inactivity, a watch winder for such automatic chronometers has been shown to be valuable.

2. History of the Prior Art

Certain prior art approaches to watch winders have included apparatus for simulating the motion of the wearer's wrist. For example, U.S. Pat. No. 3,620,007, entitled "Watch Winding Apparatus" and issued to Robert C. Kauffman on Nov. 16, 1971,discloses such a motion simulation device. However, the relationship of the axis of rotation of the stem of the internal winding rotor of the watch to the support shaft of the winding apparatus is generally orthogonal and does not maximize effeciency in turning rotation of the support shaft of the apparatus into rotation of the winding rotor of the watch.

It would be an advantage therefore to avoid the problems of the prior art by providing an apparatus which affords maximum winding effectiveness and does not require reciprocal winding movement. The invention herein sought to be patented rotates the watch in an axis of rotation coincident with the axis of rotation of the stem of the internal winding rotor. Thus, even at very slow speeds which result in minimal wear on the winding mechanism of the watch, the present invention may wind a self-winding mechanical wrist watch so that it is maintained in a fully wound-up and running state.

SUMMARY OF THE INVENTION

The invention relates to a rotary device for continuously winding a self-winding wrist watch is not being worn. In this manner, the fully wound-up watch may continue to run and thus keep time and maintain day/-date sequence if so equipped and also to retard congealment of the oil that occurs when a watch is idle for an extended period of time. More particularly, one aspect of the invention involves a synchromous, or a battery operated, motor which rotates the winding shaft at any selected speed, preferably between 5 and 40 revolutions per hour, on a wrist-size mandrel. A self-winding wrist watch may be held by its strap or band to a flat area of the detachable mandrel which attaches by means of a friction or magnetic catch to the off-center section or the winding shaft from the motor. The mandrel-to-shaft catch is notched so that the mandrel holding the watch may be attached to the shaft only in either of the two possible positions whereby the watch will rotate with its axis of rotation coincident with the axis of rotation of the stem of the internal self-winding rotor of the watch thus putting the winding rotor of the watch in rotation which corresponds with the rotation of the winding shaft of the device and thereby winding the watch as though it were in motion on the wearer's wrist.

The apparatus of the present invention may be useful in several applications. It may be mounted in a watch box either to be purchased separately by the owner of the watch or else supplied with new watches by the watch manufacturer. Moreover, in another aspect of the invention, the winding shaft of the winding apparatus can be made longer in order to accomodate more than one mandrel so that a watch repairman may simultaneously check the performance of the self-winding mechanisms of several watches under simulated wrist movement. Similarly, the device can be utilized by a merchant to keep display watches running in a showcase window. It may thus readily appreciated that this device has many useful applications in situations where it is desirable to keep a self-winding wrist watch wound up and running during periods when it is not actually being worn.

DETAILED DESCRIPTION

Figure 1:
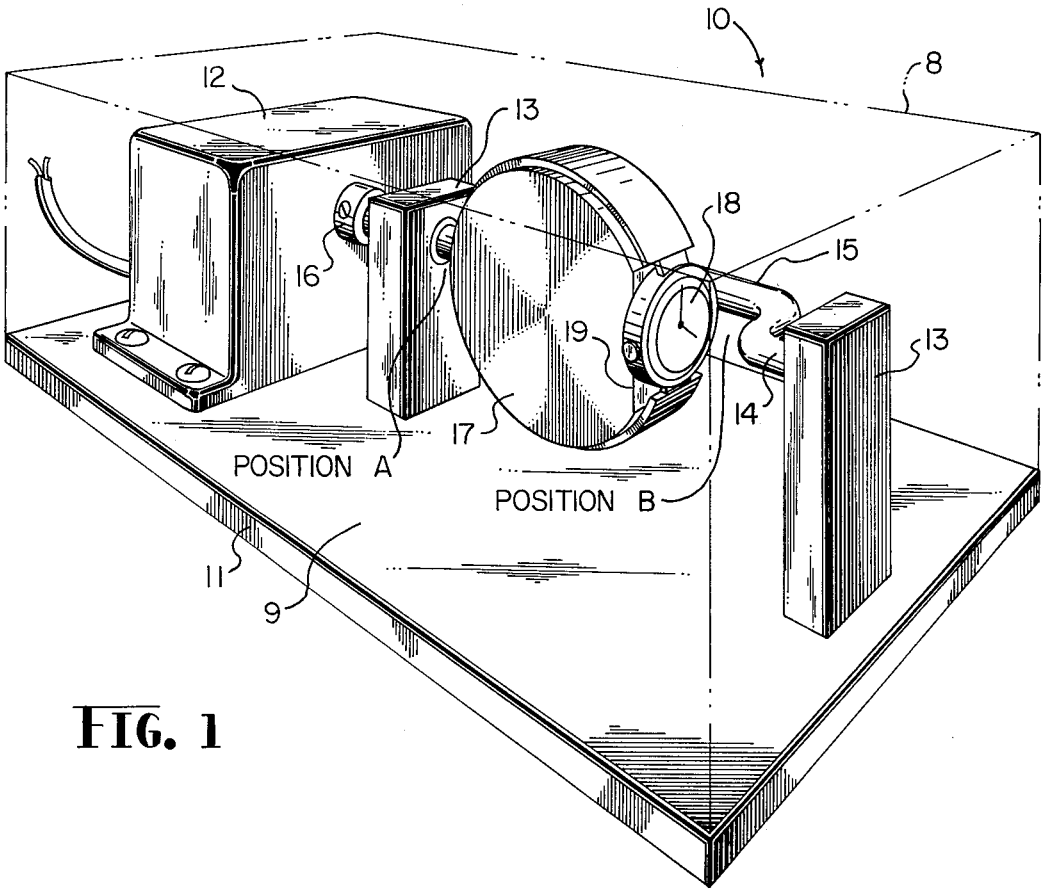
FIG. 1 is a perspective view of one embodiment of a watch winding apparatus constructed in accordance with the principles of the present invention and shown coupled to a watch in a box for purposes of illustration.
Figure 2:
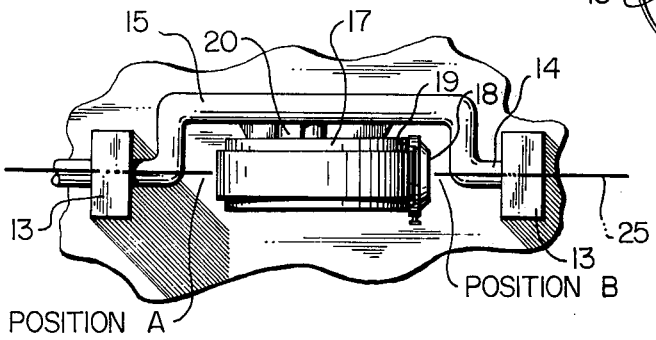
FIG. 2 is top plan, fragmentary view of the apparatus of FIG. 1, showing the mandrel with the watch attached to the offset portion of the winding shaft.
Figure 3:
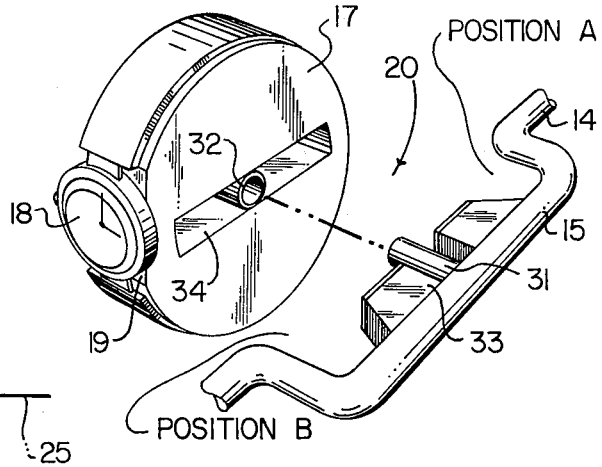
FIG. 3 is an exploded, fragmentary view of one embodiment of a mandrel-to-shaft catch incorporated into the apparatus of FIG. 1.

Referring now to FIGS. 1 through 3, there is shown one embodiment of a watch winder 10, constructed in accordance with the principles of the present invention, and positioned in a watch box 8 for purposes of illustration. As shown herein reference numeral 11 designates a base on which is mounted a synchronous or battery powered motor and rotary driving mechanism 12 and a pair of support bearings 13—13. The box 8 may be padded within and constructed with one transparent side wall 9 for purposes of viewing a watch being wound inside.

Referring specifically to FIG. 1, there is shown a winding shaft 14, with an offset area 15, connected to the motor and rotary driving mechanism 12 by a friction clutch 16 and supported by the pair of support bearings 13—13. The driving mechanism 12 may be of the continuous or intermittent drive variety. Reference numeral 17 designates a detachable wrist-size mandrel, which may be padded, shown with a self-winding mechanical wrist watch 18 placed over a flattened area thereof 19. A friction or magnetic mandrel-to-shaft catch 20 secures the mandrel 17 to the offset area 15 of the winding shaft 14 only in either of the two positions (A or B and here shown in position B) wherein the flattened area 19 of the mandrel 17 is aligned closest to the winding shaft 14. A function of the mandrel-to-shaft catch 20 is to allow the mandrel 17 to be removed from the winding shaft 14 for convenience when a watch is mounted on or removed from the mandrel 17 and further to allow attachment of the flattened area of the mandrel 19 only in either of the two positions A or B relative to the winding shaft 14. A function of the friction clutch 16 is to allow rotation by hand of the winding shaft 14 to a convenient position for removal or replacement of the mandrel 17 in the winder 10.

Referring now to FIG. 2, there is more clearly shown the generally U-shaped offset area 15 of the winding shaft 14 and its spatial relation to the mandrel 17. The winding shaft 14 is herein referred to as eccentric because of the offset area 15. The mandrel 17 is attached by the mandrel-to-shaft catch 20 to the offset area 15 of the winding shaft 14 with its flattened area 19 either in position A or B relative to the winding shaft 14 (here shown in position B). When the mandrel 17 and the offset area 15 of the winding shaft 14 are thus related, the axes of rotation 25 of the winding shaft 14 and the stem of the internal self-winding rotor of the watch 18 placed over the flattened area 19 of the mandrel 17 are coincident. A function of the offset area 15 of the winding shaft 14 is to compensate for the thickness of the mandrel 17 in order to effect coincident axes of rotation 25 of the winding shaft 14 and the stem of the internal self-winding rotor of the watch 18.

Referring now to FIG. 3, there is shown a diagrammatic drawing of the friction or magnetic mandrel-to-shaft catch 20. Reference numeral 31 designates a guide pin which projects from the offset area 15 of the winding shaft 14, and numeral 32 designates a guide pin receiver located in the center of the mandrel 17. The guide pin receiver is slipped over the guide pin 31 to facilitate initial positioning of the mandrel 17 on the offset area 15 of the winding shaft. Final positioning and securing of the mandrel 17 to the offset area 15 of the winding shaft 14 is accomplished by a friction or magnetic blade 33 extending from both sides of the guide pin 31 along much of the length of the offset area 15 of the winding shaft 14. The blade 33 fits into a tight frictional or magnetic slit 34 located in the mandrel 17 as a deep cut across the guide pin receiver 32. The frictional or magnetic slit 34 is made along the one diameter of the mandrel 17 that is perpendicular to the plane of the flattened area 19 of the mandrel 17. The relative positions of the blade 33 and the slit 34 of the friction or magnetic mandrel-to-shaft catch 20 are such that the mandrel 17 may be attached and secured to the offset area 15 of the winding shaft 14 only with its flattened area 19 located either in position A or B relative to the winding shaft 14 (here shown in position B). Where the watch 18 is placed over the flattened area 19 of the mandrel 17, the friction or magnetic mandrel-to-shaft catch 20 functions to secure the mandrel 17 holding the watch 18 to the winding shaft 14 of the winder 10 so that the axes of rotation of the winding shaft 14 and the stem of the internal self-winding rotor of the watch 18 are coincident.

In operation, the invention operates by winding a self-winding mechanical wrist watch by slowly rotating the watch on a winding shaft with the axis of rotation of the winding shaft being generally coincident with the axis of rotation of the stem of the internal self-winding rotor of the watch . With this rotational relation between the intact watch and its internal self-winding rotor, gravitational force holds the rotor stationary while the remainder of the watch, including its internal self-winding mechanism, is rotated by the winding shaft of the invention to actuate the self-winding mechanism of the watch. Each time the invention rotates the watch through one full revolution while gravity holds its internal self-winding rotor stationary, the self-winding mechanism of the watch is also rotated through one full revolution and imparts that motion to the winding of its mainspring. In this manner the invention winds with maximum efficiency a self-winding mechanical wrist watch to keep it running during intervals when it is not being worn on the wrist.

having described the invention in connection with certain specific embodiments thereof, it is to be understood that further modifications may now suggest themselves to those skilled in the art, and it is intended to cover such modifications as fall within the scope of the appended claims.

What is claimed is:

1. Apparatus for winding a mechanical self-winding wrist watch having an internal self-winding stem and rotor, said apparatus comprising:

a detachable mandrel adapted for the mounting of a watch thereon;

an eccentric winding shaft rotatably mounted to said mandrel wherein the axes of rotation of the watch supported by said mandrel and that of the stem of the internal self-winding rotor of the watch are coincident with the axis of rotation of said winding shaft;

a catch for securing said mandrel to said eccentric winding shaft; and means for imparting rotation to said winding shaft and said mandrel attached thereto for the winding of a wrist watch mounted thereon.

2. The apparatus as set forth in claim 1 wherein the rotation of the winding shaft is unidirectional and between 5 and 40 revolutions per hour.

3. The apparatus as set forth in claim 1 wherein said means for imparting rotation to said winding shaft includes a synchronous electric motor adapted for continuous rotation.

4. The apparatus as set forth in claim 1 wherein said means for imparting rotation to said winding shaft includes a battery-powered motor adapted for continuous rotation.

5. The apparatus as set forth in claim 1 wherein said means for imparting rotation to said winding shaft includes a synchronous electric motor adapted for intermittent rotation.

6. The apparatus as set forth in claim 1 wherein said means for imparting rotation to said winding shaft includes a battery-powered motor adapted for intermittent rotation.

7. The apparatus as set forth in claim 1 wherein the winding shaft's eccentricity includes a generally U-shaped offset portion wherein the axis of rotation of the stem of the internal self-winding rotor of a watch mounted on the apparatus is coincident with the axis of rotation of the winding shaft of the apparatus.

8. The apparatus as set forth in claim 1 and including a blade and slit structure in a frictional mandrel-to-winding shaft catch which allows attachment of the mandrel to the winding shaft only in one of the two positions in which the watch rotates with an axis of rotation coincident with the axis of rotation of the stem of the internal self-winding rotor of the watch.

9. The apparatus as set forth in claim 8 wherein said mandrel-to-winding shaft catch is magnetic for allowing attachment of the mandrel to the winding shaft.

10. The apparatus as set forth in claim 1 wherein the detachable mandrel has a flattened area on its circumferential periphery whereupon a watch is placed and is held in that place by its wrist band which is wrapped around the remaining circumferential portion of the mandrel.

11. The apparatus as set forth in claim 1 wherein a friction clutch is connected to the winding shaft and includes means for manually rotating the winding shaft to position it for easy access to the mandrel.

12. The apparatus as set forth in claim 1 wherein the winding shaft includes a plurality of eccentric areas and mandrels for simultaneously winding a plurality of watches mounted thereon.

13. The apparatus as set forth in claim 1 wherein the device is adapted for being housed in a watch box .

14. The apparatus as set forth in claim 13 wherein at least one side wall of said watch box is formed of transparent material for viewing the winding apparatus therein.

* * * * *